US006972780B2

(12) United States Patent
Bjorkman et al.

(10) Patent No.: US 6,972,780 B2
(45) Date of Patent: Dec. 6, 2005

(54) SYSTEM AND METHOD OF PRINTING ON THERMOCHROMIC FILM

(75) Inventors: Gerald D. Bjorkman, Portland, OR (US); David H. Koizumi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 636 days.

(21) Appl. No.: 10/057,264

(22) Filed: Jan. 25, 2002

(65) Prior Publication Data

US 2003/0142061 A1 Jul. 31, 2003

(51) Int. Cl.[7] ..... B41J 2/32
(52) U.S. Cl. ..... 347/171
(58) Field of Search ..... 347/171, 221, 347/194; 503/200; 400/120.01, 120.14

(56) References Cited

U.S. PATENT DOCUMENTS 4,734,359 A * 3/1988 Oguchi et al. ..... 346/135.1
4,756,758 A 7/1988 Lent et al.
4,851,924 A 7/1989 Nakamura et al.
5,262,374 A * 11/1993 Okabe et al. ..... 503/201
5,514,635 A 5/1996 Filo
5,786,838 A 7/1998 Steinhauser et al.
6,413,305 B1 7/2002 Mehta et al.
6,562,755 B1 5/2003 Halbrook, Jr. et al.

FOREIGN PATENT DOCUMENTS

JP 56-086777 * 7/1981 ..... B41M 5/18
JP 07-089242 * 4/1995 ..... B41M 5/26

* cited by examiner

*Primary Examiner*—Huan Tran
(74) *Attorney, Agent, or Firm*—Blakely, Sokoloff, Taylor & Zafman LLP

(57) ABSTRACT

One aspect of the invention involves a thermal image generation device comprising a casing forming an interior cavity. One surface of the casing includes a screen with thermochromic material attached to a bottom surface of the screen. The casing houses at least one thermal transfer element movable over regions of the thermochromic material to alter a temperature at the regions from a steady-state, ambient temperature. Such temperature alterations temporarily cause a color variation to the thermochromic material until the regions of the thermochromic material return to the ambient temperature.

19 Claims, 6 Drawing Sheets

SYSTEM AND METHOD OF PRINTING ON THERMOCHROMIC FILM

FIELD

The invention generally relates to the field of thermal image generation. In particular, one embodiment of the invention relates to a system and technique for altering a surface of a thermochromic film to form graphical representations that are temporarily visible until the thermochromic film returns to its normal, ambient temperature.

GENERAL BACKGROUND

Over the past few decades, efforts have been made to conserve our national resources. While it is now commonplace for residential communities to participate in recycling programs, greater strides in conservation are now necessary for businesses. For example, in order to reduce wasteful usage of paper and other costly office supplies, more and more businesses are providing employees with erasable illustrative aids such as blackboards and whiteboards. However, these illustrative aids require a person to manually write or draw an image directly on to the illustrative aid.

Currently, printers normally use ink or toner cartridges that permanently print a graphical representation on paper or plastic slides. Even thermal printers generate graphical representations that a permanent until erased by a thermal heating process. These printing mechanisms are unable to temporarily produce a graphical representation (e.g., text or image) on a surface without user activity and that automatically fades away after a prescribed period of time.

BRIEF DESCRIPTION OF THE DRAWINGS

The features and advantages of the invention will become apparent from the following detailed description of the invention in which.

DETAILED DESCRIPTION

In general, one embodiment of the invention relates to a thermal image generation device and its associated method for visually altering a thermochromic material (e.g., a thermochromic film) in response to a change in temperature until the thermochromic material returns to its ambient temperature. For one embodiment, the visual alteration causes graphical representations, namely text and/or images, to be temporarily visible on the thermochromic material.

Herein, certain details are set forth in order to provide a thorough understanding of the invention. Of course, it is contemplated that the invention may be practiced through many embodiments other that those illustrated. Well-known circuits and operations are not set forth in detail in order to avoid unnecessarily obscuring the present invention.

Figure 1:
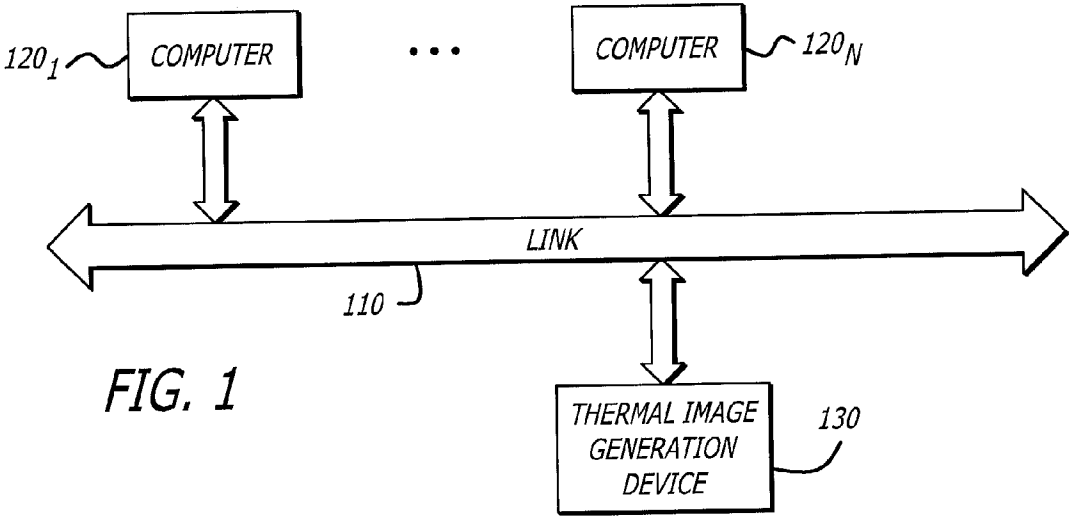
FIG. 1 is an exemplary block diagram of a first embodiment of a thermal image generation device operating as a distributed node of a network.

Referring to FIG. 1, an exemplary block diagram of a first embodiment of a thermal image generation device operating as a distributed node of a network is shown. One example of the thermal image generation device includes a writing tablet of any size or configuration. Of course, this embodiment is for illustrative purposes and other embodiments may incorporate the inventive aspects described herein.

Configured as a local area network (LAN) or as a wide area network (WAN), the network 100 comprises a link 110 interconnecting one or more ($N \geqq 1$) computers $\mathbf{120}_1$–$\mathbf{120}_N$ (e.g., desktop, a laptop, a hand-held, a server, a workstation, etc.). The link 110 is an information-carrying medium (e.g., electrical wire, optical fiber, cable, bus, or air in combination with wireless signaling technology) that is adapted to establish communication pathways between the computers $\mathbf{120}_1$–$\mathbf{120}_N$ and a thermal image generation device 130.

As shown, the thermal image generation device 130 operates as a centralized output device, which is adapted with logic, namely hardware, firmware, software module(s) or any combination thereof. Herein, a "software module" is a series of code instructions that, when executed, performs a certain function. Examples of such code include an operating system, an application, an applet, a program or even a subroutine. Software module(s) may be stored in a machine-readable medium, including but not limited to an electronic circuit, a semiconductor memory device, a read only memory (ROM), a flash memory, an erasable ROM (EROM), a floppy diskette, a compact disk, an optical disk, a hard disk, a fiber optic medium, a radio frequency (RF) link and the like.

Figure 2:
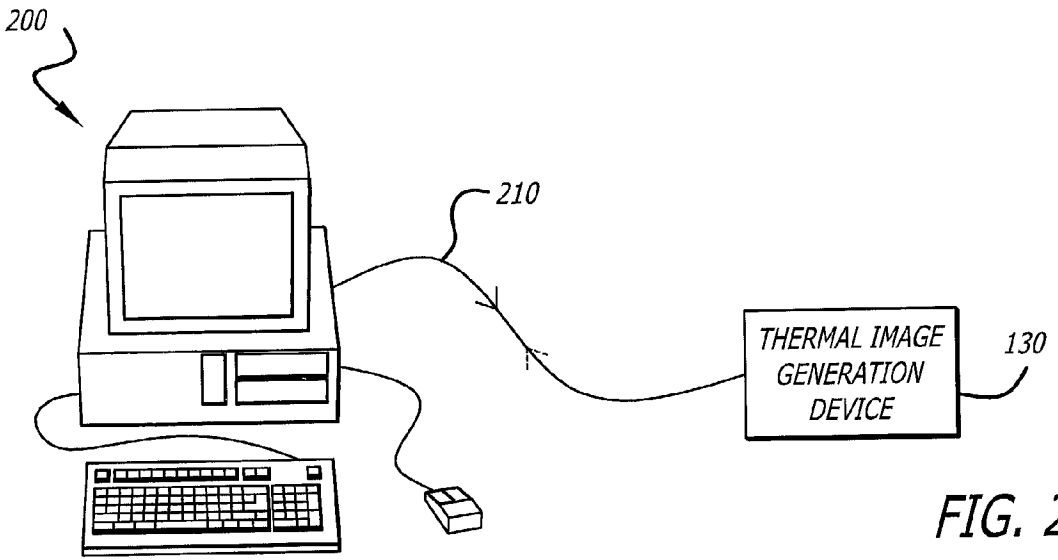
FIG. 2 is an exemplary block diagram of a second embodiment of the thermal image generation device operating as a dedicated output device of a computing unit.

Referring now to FIG. 2, an exemplary block diagram of a second embodiment of the thermal image generation device 130 operating as a dedicated output device such as a writing tablet is shown. The thermal image generation device 130 is coupled to a computer 200 over a dedicated link 210. This enables information to be downloaded from the computer 200 to the thermal image generation device 130. As an alternative, the thermal image generation device 130 may be configured as an input/output (I/O) device for uploading information to the computer 200 as represented by a dashed arrow. This may be accomplished by implementing the thermal image generation device 130 with a touch screen, keypad or another input mechanism.

Figure 3A:
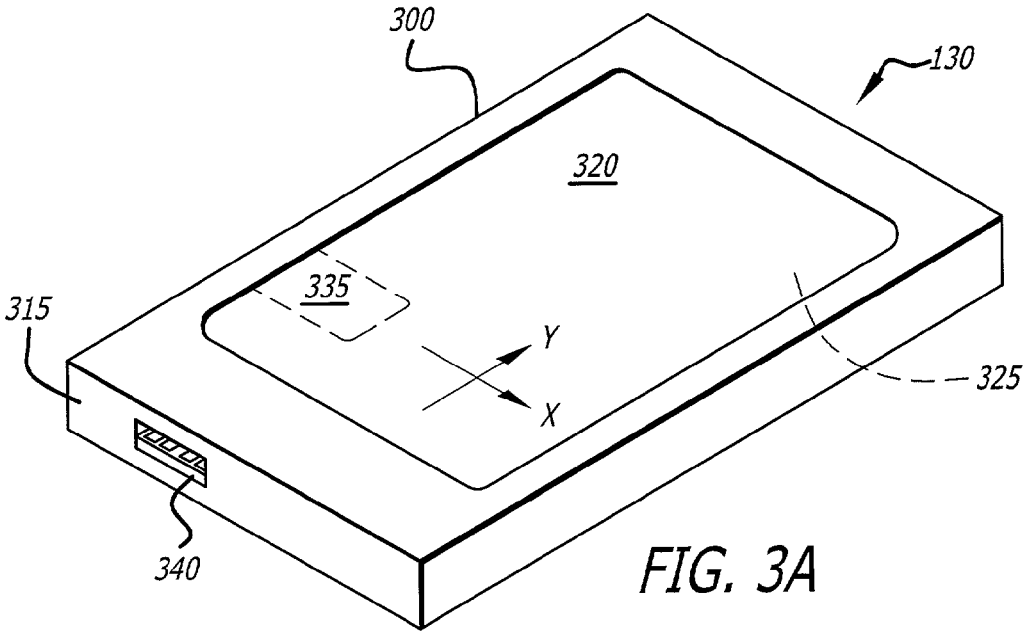
FIGS. 3A and 3B are exemplary block diagrams of a detailed embodiment of the thermal image generation device of FIG. 1 or 2 with a thermochromic film positioned adjacent to a cover.
Figure 3B:
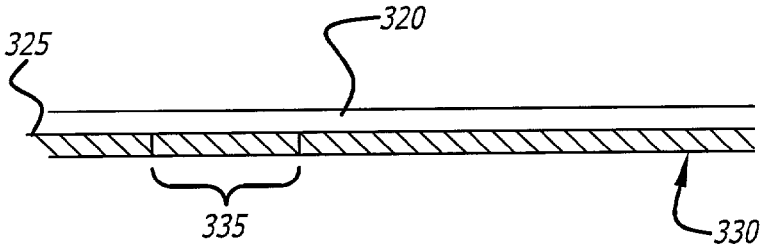

Referring to FIGS. 3A and 3B, exemplary block diagrams of a detailed embodiment of the thermal image generation device 130 of FIG. 1 or 2 is shown. The thermal image generation device 130 comprises a casing 300 made of a rigid material such as hardened plastic. The casing 300 provides a cavity for housing logic (e.g., thermal transfer element(s), processor, thermal sensor(s), etc.) and protecting such logic from damage caused by environmental conditions. One surface 310 of the casing 300 features a screen 320 made of a semi-opaque material having a transparent or translucent quality (e.g., glass, plastic, etc.).

A thermochromic film 330 is attached to the screen 320. As shown in FIG. 3B, for this embodiment, the thermochromic film 330 is applied to a bottom surface 325 of the screen 320 by a lamination process. Of course, other application techniques may be utilized.

Referring back to FIG. 3A, a side surface 315 of the casing 300 enables a connector port 340 to be accessible through the casing 300. For instance, in one embodiment, the connector port 340 may be configured to receive an adapter to the link 110 (e.g., Ethernet adapter) that enables communications over the network 100 as shown in FIG. 1. Alternatively, the connector port 340 may include a serial port, a parallel port or a Universal Serial Bus (USB) port for communications with the computer 200 of FIG. 2 or even a wireless receiver or transceiver (e.g., light emitting diode "LED" detector, a radio frequency "RF" receiver or transceiver, etc.). Of course, multiple connector ports may be provided to support different types of adapters.

In response to applying a temperature to a region 335 of the thermochromic film 330, this temperature differing from its ambient temperature (Ta) by a temperature difference (T1), the thermochromic film 330 within the region 335 experiences a color variation. The color variation may be applied in any chosen pattern to represent an image, alphanumeric character, a reference point or any other graphical representation, depending on the manner in which changes in temperature (Ta±T1) are applied to the thermochromic film 330. For instance, the temperature difference T1 may be greater than or equal to one degree Celsius (≧1° C.)

Figure 4:
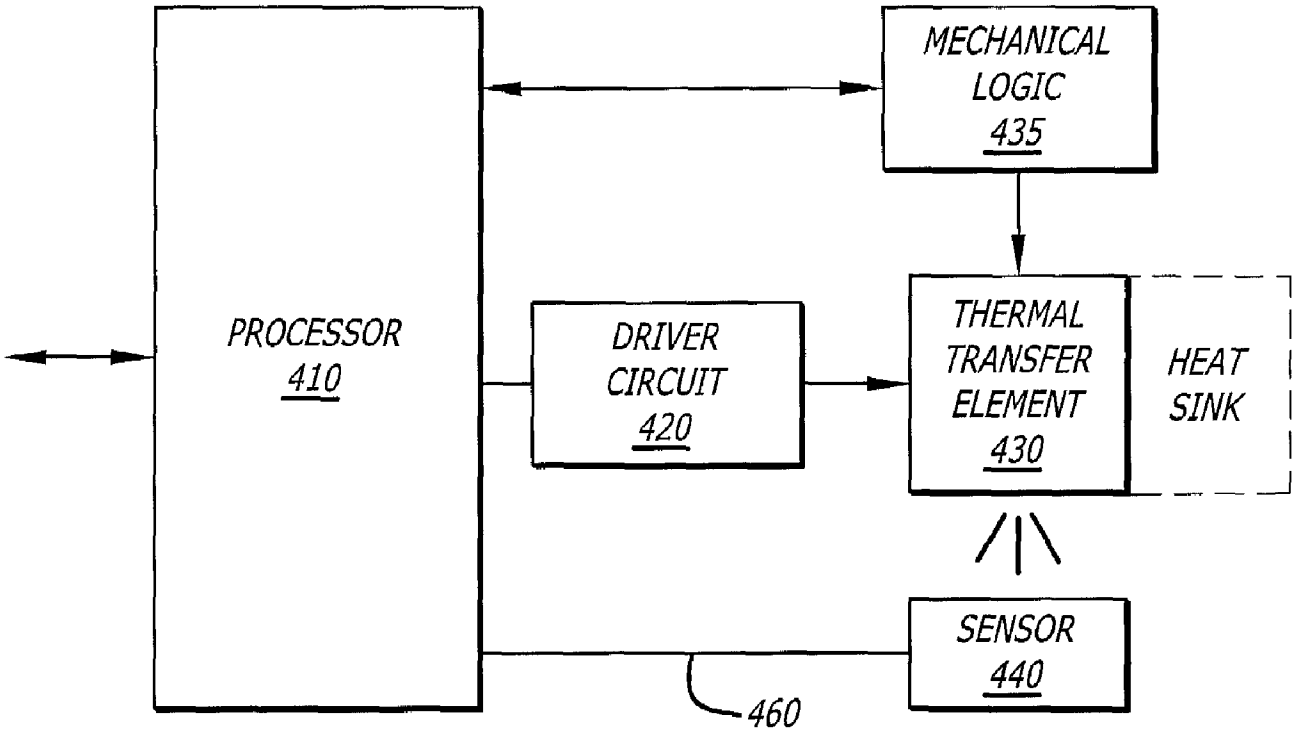
FIG. 4 is an exemplary block diagram of an embodiment of logic employed within the thermal image generation device of FIGS. 3A and 3B.

Referring to FIG. 4, an exemplary block diagram of an embodiment of logic within the casing 300 of the thermal image generation device 130 of FIGS. 3A and 3B is shown. The logic 400 comprises a processor 410, a driver circuit 420, a thermal transfer element 430 and a sensor 440. In response to information downloaded from a remote source (e.g., computer) or retrieved from internal memory situated within the casing 300, the processor 410 controls the driver circuit 420. The driver circuit 420 activates and controls the thermal transfer element 430 so as to alter the temperature of certain regions of the thermochromic film from its ambient temperature (Ta) to a resultant temperature (Ta±T1).

Herein, for one embodiment, the driving circuit 420 may be a light source (e.g., light emitting diode, laser, etc.). For this embodiment, the heat transfer element 430 is generally a light beam produced by the light source and a combination of filters and lenses, which adjust the light beam.

Alternatively, the driving circuit 420 may be a voltage and/or current regulator to adjust the voltage and/or current realized by the thermal transfer element 430. For this embodiment, the thermal transfer element 430 may be adapted as a single thermal element such as a semiconductor or an impedance component (e.g., a resistor, inductor, potentiometer, capacitor, etc.).

Where the thermal transfer element 430 is effectively a light beam produced by a combination of filters (e.g., Fresnel lens) and lenses, the adjustment of the light beam may be controlled by mechanical logic 435. For this embodiment, the mechanical logic 435 includes, but is not limited or restricted to mirror(s) controlled by galvanometers. Also, the mechanical logic 435 may provide feedback regarding the direction of the light beam deflected by the positioning of the mirror(s) over link 450.

Where the thermal transfer element 430 is employed as an impedance component, the mechanical logic 435 enables placement of the thermal transfer element 430 along an X, Y axial region bounded by the perimeter of thermochromic film proximate to the screen 320 of FIGS. 3A and 3B. For instance, the mechanical logic 435 may be a roller assembly having an array of thermal elements (see FIG. 5) that controls Y-axis placement of the array along the thermochromic film 330. Alternatively, the mechanical logic 435 may be an assembly that enables one or more thermal elements to be independently positioned anywhere along the thermochromic film 330. The mechanical logic 435 provides feedback regarding the X and/or Y-axis screen position of the thermal transfer elements.

The sensor 440 regulates the temperature applied to the region 335 and provides such information to the processor 410 over link 460. Upon receipt of the feedback information from the sensor 440, the processor 410 responds accordingly by controlling the mechanical logic 435 to alter placement of the thermal transfer element 430, the driver circuit 420 to activate/deactivate the thermal transfer element 430 or a combination thereof.

Figure 5:
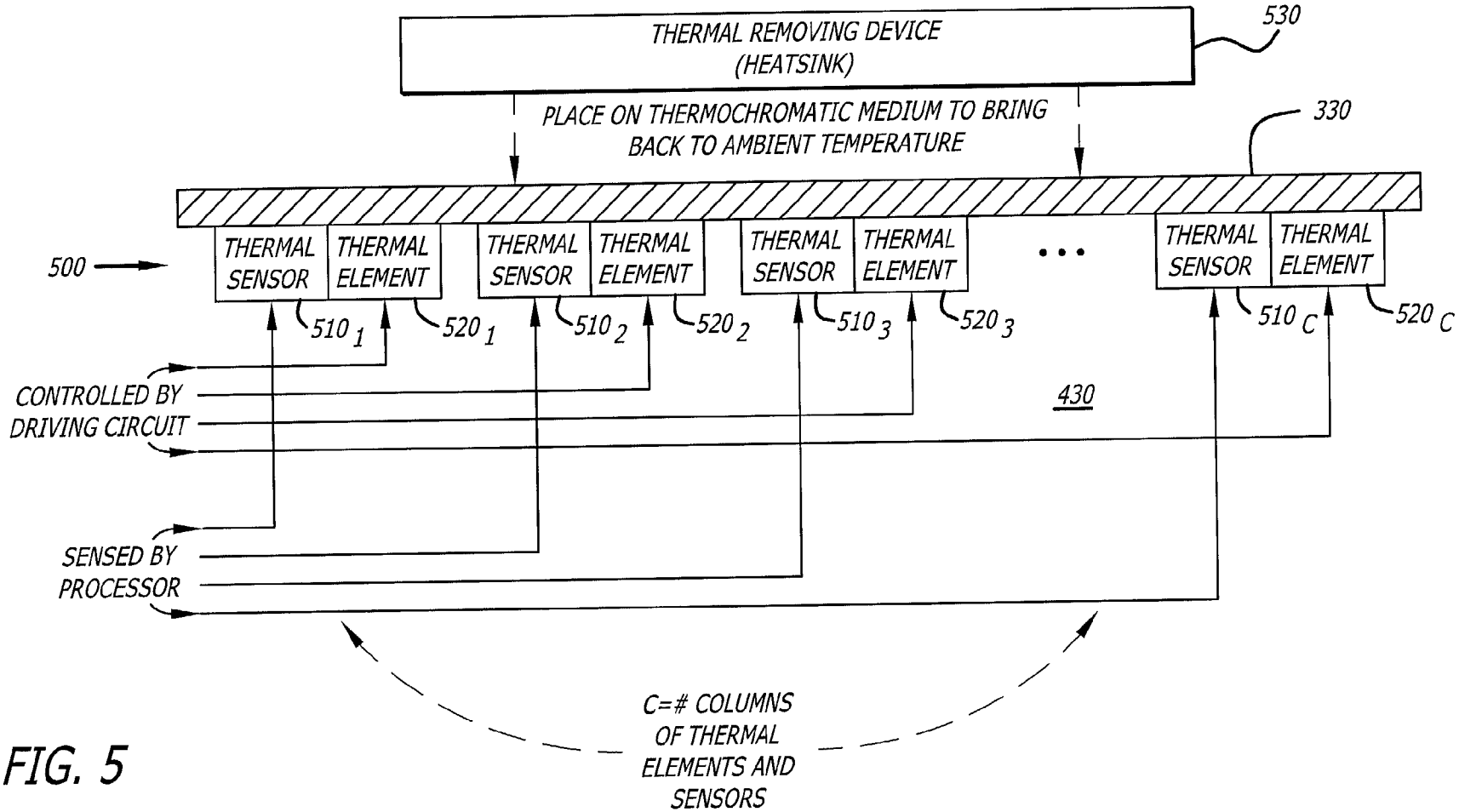
FIG. 5 is an exemplary block diagram of an embodiment of a thermal transfer element of the thermal image generation device of FIG. 1.

Referring to FIG. 5, an exemplary block diagram of an embodiment of the thermal transfer element utilized within the thermal image generation device 130 is shown. The thermal transfer element 430 includes an array of thermal elements 500 that are laterally spaced apart (X-axis) and adjacent to the thermochromic film 330. Namely, the array 500 forms a single row of thermal elements $\mathbf{510}_1$–$\mathbf{510}_c$ (where "C"≧1). Such spacing is static in nature and may extend across the entire width of the thermochromic film 330 or along a particular region 335 as illustrated in FIGS. 3A and 3B.

The mechanical logic 435 adjusts the longitudinal (Y-axis) placement of the array of thermal elements 500. While the mechanical logic 435 controls the longitudinal movement, each thermal element $\mathbf{510}_1$–$\mathbf{510}_c$ is discreetly controlled by the driving circuit 420. The combination of mechanical movement and thermal element control will enable a graphical representation (e.g., text, image, etc.) to be displayed temporarily on the thermochromic film 330. In addition, one or more thermal sensors (e.g., sensors $\mathbf{520}_1$–$\mathbf{510}_c$) may be employed to regulate the temperature of a corresponding thermal elements $\mathbf{510}_1$–$\mathbf{510}_M$.

Another embodiment may include a static array of thermal elements (not shown). The array may be arrange to form a numbers of rows (R, R≧1) and columns (C, C≧1). Each thermal element $\mathbf{510}_1$–$\mathbf{510}_c$ may have a corresponding thermal sensor $\mathbf{520}_1$–$\mathbf{520}_c$. Each thermal element $\mathbf{510}_1$–$\mathbf{510}_c$ would be under discreet control. This implementation would not have any mechanical assembly to control placement of a single array of thermal elements as described above.

It is contemplated that a thermal removing device (e.g., a heat sink) 530 may be coupled as part of the logic 400 of FIGS. 4 and 5 to assist in returning thermochromic film 330 back to ambient room temperature. This will assist the thermochromic film 330 in changing back to ambient color state in a timely fashion.

Figure 6:
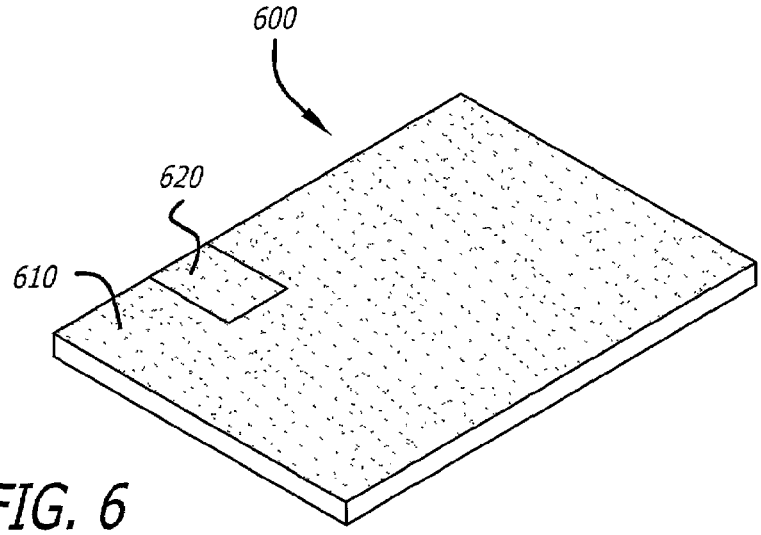
FIG. 6 is an exemplary block diagram of another detailed embodiment of the thermal image generation device of FIGS. 1 or 2 with thermochromic micro-capsules embedded into the material forming the cover.

Referring now to FIG. 6, an exemplary block diagram of another detailed embodiment of the thermal image generation device 130 of FIG. 1 or 2 is shown. In lieu of a screen/film combination 320, 330 of FIGS. 3A and 3B, material forming the screen 600 is also embedded with thermochromic micro-capsules 610. In response to a region 620 of the screen 600 experiencing a change in temperature (T1) from its ambient temperature (Ta), namely the application of a resultant temperature (Ta±T1) to the region 620, the thermochromic micro-capsules 610 within that region 620 experience a color variation. The color variation experienced by these thermochromic micro-capsules 610 is temporary and returns to its normal color as the resultant temperature returns to the ambient temperature (Ta).

Figure 7:
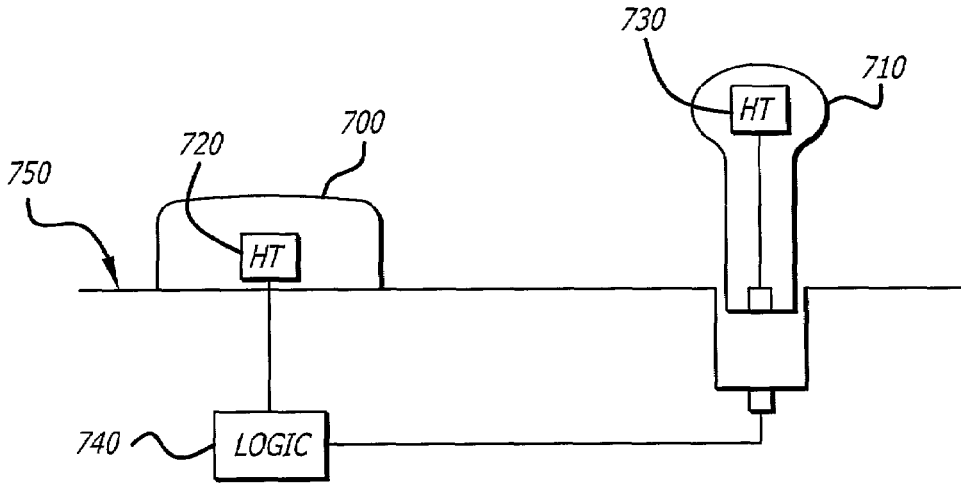
FIG. 7 is an exemplary block diagram of an embodiment of a product adapted to receive an external add-on device made in part with thermochromic micro-capsules to represent different operational states of the product.

Referring now to FIG. 7, an exemplary block diagram of an embodiment of a product adapted with integrated components and/or with attachable components made in part with thermochromic micro-capsules is shown. For instance, the integrated component 700 and/or attachable component 710 are injected molded plastic elements formed with a thermal transfer element 720 and 730, respectively. Each of the thermal transfer elements 720 and 730 may be one or more impedance elements.

In one embodiment, in response to a certain condition (e.g., power up, correct depression of a button, etc.), the thermal transfer element 720 is configured to receive current from internal logic 740 within the product 750. This causes the thermal transfer element 720 to generate additional thermal heat, which results in the thermochromic material within the integrated component 700 changing color. The same or even a different event may cause the internal logic 740 to apply current to the thermal transfer element 730 of the attachable component 710.

Of course, in response to a certain condition (e.g., power-off, incorrect depression of a button, etc.), the internal logic 740 may discontinue current supplied to the thermal transfer elements 720 and/or 730, which returns the thermochromic material within the components 700 and/or 710 to its ambient temperature and color.

Figure 8:
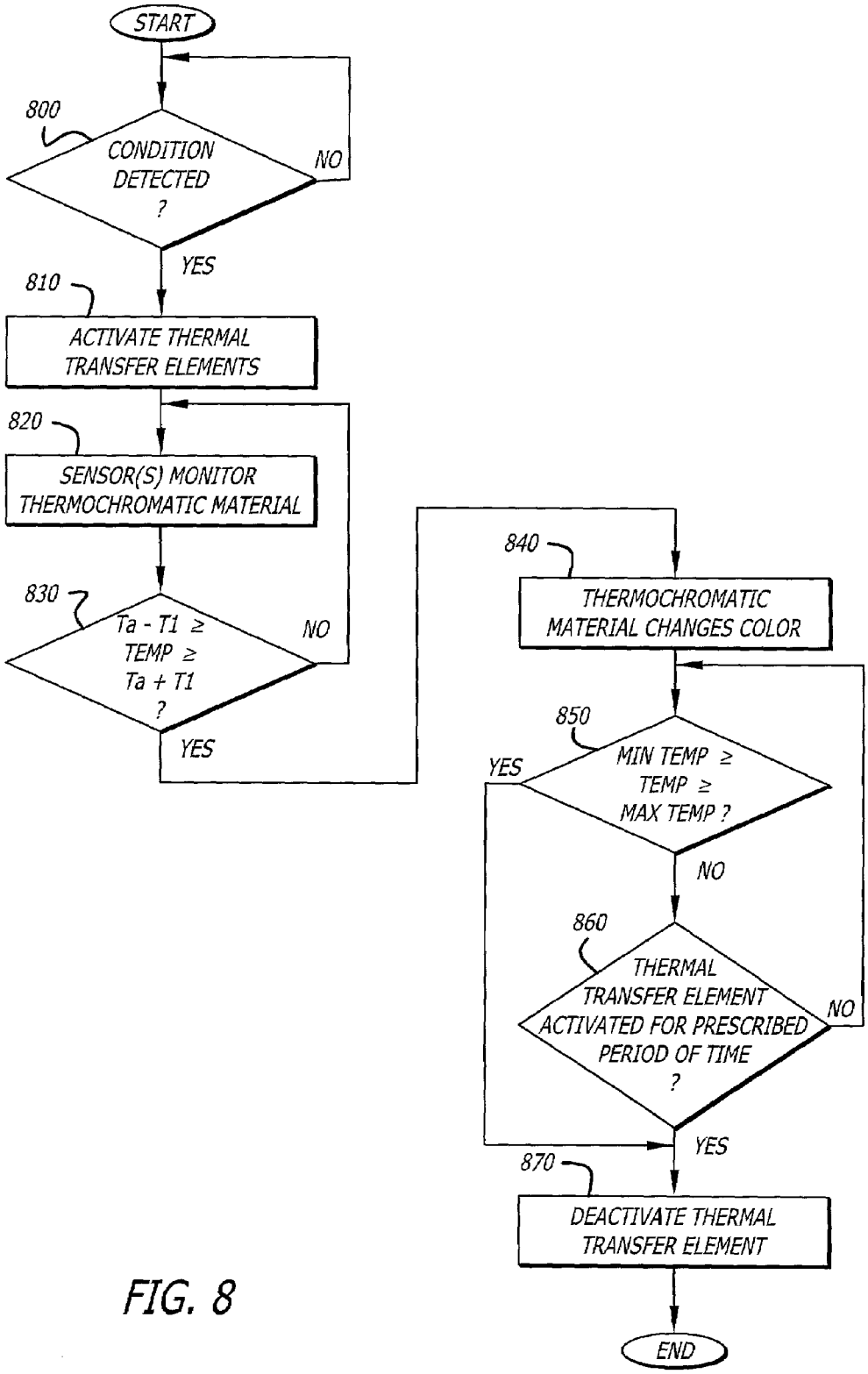
FIG. 8 is an exemplary flowchart of the operations of the invention.

Referring now to FIG. 8, an exemplary flowchart of the operations of the invention is shown. In response to a condition (e.g., power up, depression of a button, etc.), a thermal transfer element is activated to alter the temperature of thermochromic material (blocks 800 and 810). The thermochromic material may be an entire sheet of thermochromic film or a particular region, thermochromic material mixed with other material as a composite and the like.

One or more sensors are used to monitor the temperature of the thermochromic material in order to determine whether it has experienced a sufficient temperature difference to alter the color of the thermochromic material (blocks 820 and 830). For example, for this embodiment, the sensor(s) may be used to determine if the temperature of the thermochromic material has risen above or fallen below its ambient temperature (Ta) by a selected temperature difference (T1) causing the thermochromic material to change color (block 840).

The sensor(s) also periodically monitor if the temperature of the thermochromic material has risen above a maximum temperature or fallen below a minimum temperature (block 850). Also, the sensor(s) monitor whether temperature of the thermochromic material has remained at this temperature for a prescribed period of time (block 860). Upon confirming that at least one of these events has occurred, the thermal transfer element may now be deactivated (block 870). This would allow gradual fading of the displayed graphical representation as the thermochromic material returns to its ambient temperature.

Such deactivation may be to substantially reduce current applied to and/or voltage realized by one or more thermal elements being impedance elements. Where the thermal transfer element is a light beam, deactivation is accomplished by discontinuing or deflecting the light beam.

Alternatively, if the maximum or minimum temperature has not been met or exceeded, the thermal transfer element may continue to be activated or periodically throttled between an activated and deactivated state in order to retain the displayed graphical representation. The thermal transfer element may be deactivated in response to an affirmative action by the user (e.g., depress button, power-off, etc.). It is contemplated that a thermal removing device may be used in combination to more quickly return the thermochromic material back to its approximate ambient temperature.

While certain exemplary embodiments have been described and shown in the accompanying drawings, it is to be understood that such embodiments are merely illustrative of and not restrictive on the broad invention, and that this invention not be limited to the specific constructions and arrangements shown and described. For example, it may be possible to implement the invention or some of its features in hardware, firmware, software or a combination thereof.

What is claimed is:

1. A thermal image generation device comprising a thermochromic material;

at least one thermal transfer element movable over regions of the thermochromic material to alter a temperature at the regions from a steady-state, ambient temperature to temporarily cause a color variation of the thermochromic material until the regions of the thermochromic material return to the ambient temperature;

a driving circuit to adjust at least one of voltage and current for controlling activation and deactivation of the at least one thermal transfer element;

mechanical logic to control placement of the at least one thermal transfer element bounded by a perimeter formed by the thermochromic material;

a processor coupled to the driver circuit and the mechanical logic; and a sensor coupled to the processor, the sensor to monitor a temperature of the at least one thermal transfer element and to feedback data to the processor to enable the processor to control the driving circuit and the mechanical logic.

2. A thermal image generation device of claim 1 further comprising:

a casing forming an interior cavity, one surface of the casing including a screen onto which the thermochromic material is attached.

3. The thermal image generation device of claim 1, wherein the at least one thermal transfer element is a resistor.

4. The thermal image generation device of claim 1, wherein the mechanical logic is a roller assembly.

5. The thermal image generation device of claim 4, wherein the at least one thermal transfer element is an array of thermal elements having a fixed X-axis placement and a varying Y-axis placement controlled by the roller assembly.

6. The thermal image generation device of claim 1, wherein the at least one thermal transfer element is a combination of filters and lenses to produce a light beam.

7. A thermal image generation device comprising:

a casing forming an interior cavity, one surface of the casing including a component embedded with thermochromic material; and logic placed within the interior cavity, the logic including a thermal transfer element movable over regions of the component to alter a temperature at the regions from a steady-state, ambient temperature which temporarily causes a color variation of the thermochromic material until the regions of the thermochromic material return to the ambient temperature.

8. The thermal image generation device of claim 7, wherein the component is a screen.

9. The thermal image generation device of claim 7, wherein the component is a button on a toy product.

10. The thermal image generation device of claim 7, wherein the logic further comprises a driving circuit to adjust at least one of voltage and current for controlling activation, and deactivation of the thermal transfer element; and mechanical logic to control placement of the thermal transfer element bounded by a perimeter formed by borders of the component.

11. The thermal image generation device of claim 10, wherein the thermal transfer element of the logic is a resistor.

12. The thermal image generation device of claim 11, wherein the mechanical logic is a roller assembly.

13. The thermal image generation device of claim 12, wherein the thermal transfer element of the logic is an array of thermal elements having a fixed X-axis placement and a varying Y-axis placement controlled by the roller assembly.

14. The thermal image generation device of claim 10, wherein the logic further comprises a processor coupled to the driver circuit and the mechanical logic; and a sensor coupled to the processor, the sensor to monitor a temperature of the thermal transfer element and to feedback data to the processor to enable the processor to control the driving circuit and the mechanical logic.

15. A method comprising:

activating at least one thermal transfer element in response to a condition;

monitoring a region of a thermochromic material in close proximity to the at least one thermal transfer element in order to (i) determine if a temperature at the region varies from an ambient temperature by a selected temperature difference, causing the thermochromic material to experience a color variation, and (ii) determine if the temperature at the region exceeds a maximum temperature; and deactivating the at least one thermal transfer element if the temperature at the region exceeds the maximum temperature.

16. The method of claim 15, wherein the monitoring of the region of the thermochromic material further includes determining if the temperature at the region falls below a minimum temperature.

17. The method of claim 16 further comprising:

deactivating the at least one thermal transfer element if the temperature at the region falls below the minimum temperature.

18. The method of claim 15, wherein the condition is a depression of a button of a product including the thermochromic material.

19. The method of claim 15, wherein the thermochromic material is a film placed over a screen of a writing tablet.

* * * * *